US011440690B2

(12) United States Patent
Binacchi

(10) Patent No.: US 11,440,690 B2
(45) Date of Patent: Sep. 13, 2022

(54) APPARATUS FOR PACKAGING CAPSULES UNDER VACUUM

(71) Applicant: OPEM S.P.A., Parma (IT)

(72) Inventor: Fabio Binacchi, Sorbolo (IT)

(73) Assignee: OPEM S.P.A., Parma (IT)

( * ) Notice: Subject to any disclaimer, the term of this patent is extended or adjusted under 35 U.S.C. 154(b) by 0 days.

(21) Appl. No.: 17/291,190

(22) PCT Filed: Nov. 6, 2019

(86) PCT No.: PCT/IB2019/059542

§ 371 (c)(1),
(2) Date: May 4, 2021

(87) PCT Pub. No.: WO2020/099989

PCT Pub. Date: May 22, 2020

(65) Prior Publication Data

US 2022/0063853 A1 Mar. 3, 2022

(30) Foreign Application Priority Data

Nov. 12, 2018 (IT) ..... 102018000010250

(51) Int. Cl.
*B65B 31/02* (2006.01)
*B65B 29/02* (2006.01)
(Continued)

(52) U.S. Cl.
CPC ..... *B65B 31/028* (2013.01); *B65B 7/164* (2013.01); *B65B 29/022* (2017.08); *B65B 43/52* (2013.01); *B65B 43/54* (2013.01); *B65B 65/006* (2013.01)

(58) Field of Classification Search
CPC ..... B65B 31/028; B65B 31/02; B65B 29/022; B65B 29/02; B65B 7/164; B65B 7/16;
(Continued)

(56) References Cited

U.S. PATENT DOCUMENTS 3,653,175 A * 4/1972 Rogiers ..... B65B 9/042 53/559
4,154,044 A * 5/1979 Lang ..... B65B 31/025 53/97

(Continued)

FOREIGN PATENT DOCUMENTS

WO 2010007633 A1 1/2010
WO 2018193383 A1 10/2018

*Primary Examiner* — Dariush Seif
(74) *Attorney, Agent, or Firm* — Browdy and Neimark, PLLC

(57) ABSTRACT

An apparatus (100) for manufacturing capsules (10) under vacuum for preparing beverages is described, comprising: a plurality of support elements (105) and a driving system (120) adapted to move said support elements (105) and stop them in a plurality of operative stations, wherein each support element (105) comprises a row of housing seats (115), wherein the operative stations comprise at least: a loading station (145) for inserting into the housing seats (115) a glass-shaped body (15), a filling station (150) for filling glass-shaped bodies (15) with a food substance adapted to produce a beverage, a covering station (155) for applying and fixing on the glass/shaped bodies (15) a closing film (45), and a sealing station (160) for placing under vacuum the inner volume of the glass-shaped bodies (15) and for sealing the closing film (45) and wherein said sealing station (160) comprises: a plurality of bell-shaped members (280), each of which is adapted to overlay to one respective housing seat (115) and has mouthpiece directed downward, a movement apparatus (300) for moving each bell-shaped member (280) in vertical direction between a raised position to a lowered position, a vacuum generating apparatus (340) to reduce the inner volume of bell-shaped members (280), and a plurality of welding elements (390), each of which is contained inside a respective bell-shaped member (280) for
(Continued)

airtightly welding the closing film (45) on the glass-shaped body (15) contained in the housing seat (115).

11 Claims, 5 Drawing Sheets

(51) Int. Cl.
*B65B 7/16* (2006.01)
*B65B 43/52* (2006.01)
*B65B 43/54* (2006.01)
*B65B 65/00* (2006.01)

(58) Field of Classification Search
CPC B65B 7/28; B65B 43/52; B65B 43/54; B65B 65/00; B65B 65/006
USPC ..... 53/432
See application file for complete search history.

(56) References Cited

U.S. PATENT DOCUMENTS 4,176,507 A * 12/1979 Mancini ..... B65B 7/2878 53/329.3
4,221,102 A * 9/1980 Lang ..... B65B 31/025 53/101
4,565,052 A * 1/1986 Hautemont ..... B65B 9/042 53/559
4,625,498 A * 12/1986 Parsons ..... B65B 7/2814 53/526
4,807,424 A * 2/1989 Robinson ..... B65B 31/00 53/289
5,040,353 A * 8/1991 Evans ..... B65B 57/10 53/53
5,065,563 A * 11/1991 Robache ..... B29C 66/841 53/69
5,649,412 A * 7/1997 Binacchi ..... B65B 9/023 426/77
6,161,367 A * 12/2000 Walter ..... B65B 61/18 53/329.3
6,202,388 B1 * 3/2001 Sanfilippo ..... B65B 31/028 53/510
6,684,604 B2 * 2/2004 Luc ..... B65B 7/01 53/244
7,234,500 B2 * 6/2007 Gill ..... B65B 7/164 53/329.2
7,910,145 B2 * 3/2011 Reati ..... B65B 61/005 426/77
9,630,732 B2 * 4/2017 Hodler ..... B23P 21/004
9,688,465 B2 * 6/2017 Trombetta ..... B65B 55/24
2011/0016834 A1 * 1/2011 Rapparini ..... B65B 29/025 53/510
2011/0023417 A1 * 2/2011 Finkowski ..... B65B 47/04 53/531
2012/0204516 A1 * 8/2012 Palumbo ..... B65B 11/52 53/403
2012/0233967 A1 * 9/2012 Bellante ..... B65B 35/58 53/539
2012/0297729 A1 * 11/2012 Scolaro ..... B65B 31/02 53/79
2013/0212988 A1 * 8/2013 Schmeiser ..... B65B 47/00 483/1
2013/0263559 A1 * 10/2013 Scolaro ..... B29C 66/53461 53/329.2
2014/0141128 A1 * 5/2014 Trombetta ..... B65B 1/32 426/77
2014/0230370 A1 * 8/2014 Bianchi ..... B65B 29/022 53/410
2014/0260086 A1 * 9/2014 Schiavina ..... B29C 65/7461 53/97
2015/0056341 A1 * 2/2015 Trombetta ..... B65B 29/02 53/111 R
2015/0158609 A1 * 6/2015 Villain ..... B65B 7/164 426/112
2015/0175347 A1 * 6/2015 Empl ..... B65D 85/8061 426/433
2015/0210413 A1 * 7/2015 Schiavina ..... B29C 66/8161 53/86
2015/0336691 A1 * 11/2015 Fowler ..... B65D 65/46 53/553
2016/0068288 A1 * 3/2016 Palumbo ..... B65B 51/02 53/511
2016/0144987 A1 * 5/2016 Scrivani ..... B65B 29/02 53/487
2016/0304226 A1 * 10/2016 Rossini ..... B29C 66/8412
2016/0349138 A1 * 12/2016 Fu ..... B65B 31/00
2016/0355286 A1 * 12/2016 Cavazza ..... B65B 43/44
2017/0096243 A1 * 4/2017 Manaresi ..... B65B 61/20
2021/0122090 A1 * 4/2021 Mines ..... B65B 29/022
2022/0063853 A1 * 3/2022 Binacchi ..... B65B 7/2878

* cited by examiner

APPARATUS FOR PACKAGING CAPSULES UNDER VACUUM

TECHNICAL FIELD

The present invention relates to an apparatus for packaging capsules intended to be used in extracting machines for preparing hot beverages, such as for example coffee, tea or herbal tea. More particularly, the present invention relates to an apparatus for packaging capsules under vacuum.

BACKGROUND

As is known, one of the most common methods for preparing hot beverages such as those mentioned above is to use extracting machines of pre-packaged disposable capsules.

Each capsule generally comprises a glass-shaped body, made for example of aluminium or plastic material, which is filled with a dose of a food substance adapted to prepare the beverage by infusion and/or percolation, and is sealed at the top with a closing film of aluminium or other material.

When the capsule is inserted into the extracting machine, the bottom of the glass-shaped body and the closing film are drilled, so that a flow of hot water can pass through the capsule, coming into contact with the food substance and producing the beverage.

To better preserve the food substance during the steps of transport, storage and marketing of the capsules, this substance can be packaged inside the capsule under vacuum.

This solution is mainly used to package capsules intended for use in beverage vending machines, in which the capsules are loaded in an automated manner.

The presence of the vacuum has in fact the effect of reducing the outer dimensions of each capsule, making it easier to move through the automatic systems of the machine.

Currently these capsules under vacuum can be packaged with apparatuses comprising a plurality of support elements which are made to advance in sequence along a closed route.

Each support element has a plurality of housing seats, each of which is adapted to house a capsule.

The support elements, by advancing along their route, are stopped at a series of operative stations, of which a loading station in which the housing seats are loaded with the glass-shaped bodies intended to produce the capsules, a filling station in which the glass-shaped bodies are filled with the food substance, a covering station in which the closing films are applied and partially fixed on the glass-shaped bodies, and finally a sealing station in which the inner volume of the glass-shaped body is placed under vacuum and the sealing film is completely sealed thereon.

The sealing station comprises in particular a vacuum bell, which is lowered on one or more support elements simultaneously, so as to enclose a plurality of capsules.

Once lowered, the bell is reduced, so that the air contained inside the capsules can escape through the slots that are still present between the mouthpiece of the glass-shaped bodies and the corresponding closing films.

When the pressure level inside the bell has reached a predetermined value, special sealing members come into operation which completely seal the closing films of all the capsules present inside.

At the end of this step, the vacuum bell is raised, and the support elements can advance towards a zone for unloading the packaged capsules.

A drawback of this solution consists in the fact that the vacuum level obtained inside the capsules may be not perfectly uniform, with the result that some capsules may not comply with the required specifications and discarded as defective.

Moreover, reducing the large inner volume of the vacuum bell generally requires a high energy expenditure and a rather high time, increasing the operating costs and introducing a limit to the hourly productivity of the apparatus.

DISCLOSURE OF THE INVENTION

In light of the above, an object of the present invention is to solve, or at least significantly reduce, the mentioned drawback of the prior art.

Another object is that of achieving such objective within the context of a simple, rational and relatively cost effective solution.

These and other objects are reached by the characteristics of the invention as set forth in the independent claim 1. The dependent claims outline preferred and/or particularly advantageous aspects of the invention.

In particular, an embodiment of the present invention provides for an apparatus for manufacturing capsules under vacuum for preparing beverages, comprising:

- a plurality of support elements arranged in sequence along a closed route having at least a rectilinear and horizontal operative tract, and
- a driving system adapted to move said support elements along said closed route, advancing them into the operative tract according to a predetermined advancement direction and stopping them one at a time in a plurality of operative stations, wherein each support element comprises a row of housing seats which, at the operative tract of the closed route, are mutually aligned in a horizontal and transverse direction of alignment with respect to the advancement direction, wherein the operative stations are arranged above the operative tract of the closed route of support elements and comprise at least:

- a loading station for inserting into the housing seats a glass-shaped body having mouthpiece directed upward,
- a filling station, placed downstream of the loading station with respect to the advancement direction of the support elements, for filling glass-shaped bodies inserted in the housing seats with a food substance adapted to produce a beverage,
- a covering station, placed downstream of the filling station with respect to the advancement station of support elements, for applying and fixing on the mouthpiece of glass-shaped bodies inserted in the housing seats a closing film, and
- a sealing station, placed downstream of the covering station with respect to the advancement direction of support elements, for placing under vacuum the inner volume of the glass-shaped bodies placed in the housing seats and for sealing the closing film on the mouthpiece thereof, and wherein the sealing station comprises:

- a plurality of bell-shaped members arranged mutually placed side by side in a transverse direction with respect to the advancement direction of the support elements, each of which is adapted to overlay to one respective housing seat and has mouthpiece directed downward,
- a movement apparatus for moving each bell-shaped member in vertical direction between a raised position, wherein its mouthpiece is substantially spaced apart from the support element, to a lowered position, wherein the mouthpiece thereof leans against the support element surrounding the correspondent housing seat, a vacuum generating apparatus to reduce the inner volume of bell-shaped members, and a plurality of welding elements, each of which is contained inside a respective bell-shaped member for airtightly welding the closing film on the glass-shaped body contained in the housing seat.

Thanks to this solution, the vacuum is made individually for each capsule independently from the others, ensuring that in each capsule a level of vacuum is obtained that complies with the required specifications, reducing the percentage of defective capsules and therefore significantly increasing the productivity of the apparatus.

Moreover, since the inner volume of the bell-shaped members is generally rather small, the time and energy required to reach the desired vacuum value are lower than those normally required to create the vacuum in the large bells of the prior art, consequently reducing the process times and operating costs.

According to an aspect of the invention, the apparatus for moving the bell-shaped members can be adapted to move each bell-shaped member independently from the other bell-shaped members.

For example, the movement apparatus could comprise a plurality of jacks, preferably of the pneumatic type, each of which is connected to a respective bell-shaped member so as to move it in the vertical direction.

In this way, also the movement of the single bell-shaped members is advantageously separated, each of which can therefore be displaced into a raised position or into a lowered position independently from the other bell-shaped members.

For example, if a defective capsule is identified by a line control placed upstream of the sealing station, the bell-shaped member that is supposed to place the capsule under vacuum can be kept in the raised position and not perform the relative step, saving energy and avoiding malfunctions.

Otherwise, the presence of a defective capsule could compromise the whole operation of the apparatus.

For example, if for some reason the closing film of a capsule had not been correctly fixed to the glass-shaped body, during the generation of the vacuum, this closing film and the food substance could be sucked by the vacuum generating apparatus, with the risk of damaging it and having to stop production.

Thanks to the new solution, if the apparatus were provided with a system adapted to recognize the defect, the step for sealing under vacuum for that capsule could simply be skipped, allowing the production to be normally continued for the other capsules. According to another aspect of the invention, the vacuum generating apparatus can be adapted to reduce the inner volume of each bell-shaped member independently from other bell-shaped members.

For example, the vacuum generating apparatus could comprise a plurality of vacuum generators of the Venturi type, each of which is connected to the inner volume of a respective bell-shaped member.

In this way, it is advantageously possible to control the vacuum level precisely in each capsule, interrupting the generation of the vacuum in each bell-shaped member as soon as a desired value is reached and possibly continuing to generate the vacuum in the other bell-shaped members, if in them, this value has not been reached yet, thus optimizing energy consumption and ensuring that each capsule complies with the required specifications, reducing waste.

According to another aspect of the invention, each welding element can comprise an electrically supplied resistor.

This aspect provides a simple and functional solution to allow an effective sealing of the covering film.

A further aspect of the invention provides that each welding element can be movable, inside the corresponding bell-shaped member, between a raised position, wherein it is distant from the mouthpiece of the bell-shaped member, to a lowered position, wherein it is closer to said mouthpiece.

Thanks to this solution, the heating element can effectively start operation after the corresponding bell-shaped body has been lowered onto the support element and after the required depression value has been generated inside it to obtain the vacuum. In some embodiments, the displacement of each welding element can be obtained by means of the same movement apparatus which drives the respective bell-shaped member.

For example, the movement apparatus could be rigidly connected to the welding element and the bell-shaped member could be connected to the welding element by means of a suspension system.

In this way, during a downward displacement of the welding element, the bell-shaped member could first touch the support element and, following a further lowering of the welding element, the latter could slide inside the bell-shaped member until it reaches its lowered position.

More preferably, the sealing station can, however, comprise a second movement apparatus adapted to move each welding element between said raised position and said lowered position.

In this way, the driving of the bell-shaped member and of the welding element can be safer and more precise.

Also this second movement apparatus can be adapted to move each welding element independently from the other welding elements.

For example, also the second movement apparatus could comprise a plurality of jacks, for example of the pneumatic type, each of which is connected to a respective welding element so as to move it in the vertical direction.

In this way also the movement of the single welding elements is advantageously separated, each of which can therefore be activated (e.g. brought into a lowered position) or deactivated (e.g. kept in a raised position) according to need.

According to another aspect of the invention, the sealing station can further comprise a plurality of pressure sensors, each of which is adapted to measure the pressure inside a respective bell-shaped member.

In this way, it is advantageously possible to monitor the depression level individually for each bell-shaped member and consequently for each capsule being processed.

Each of these pressure sensor can also be connected to an electronic control unit configured for activating (e.g. displacing into lowered position) each welding element when the pressure value inside the corresponding bell-shaped member, measured by the corresponding pressure sensor, drops to a predetermined threshold value, and for controlling the vacuum generating apparatus such to interrupt vacuum generation inside said correspondent bell-shaped member, after activating said welding element.

Thanks to this solution, it is advantageously possible to automate and make the operation of the apparatus efficient.

BRIEF DESCRIPTION OF THE DRAWINGS

Further features and advantages of the invention will be more apparent after reading the following description provided by way of a non-limiting example, with the aid of the accompanying drawings.

FIG. 8 is a perspective view showing the sealing station of the apparatus of FIG. 1.

DETAILED DESCRIPTION

Figure 1:
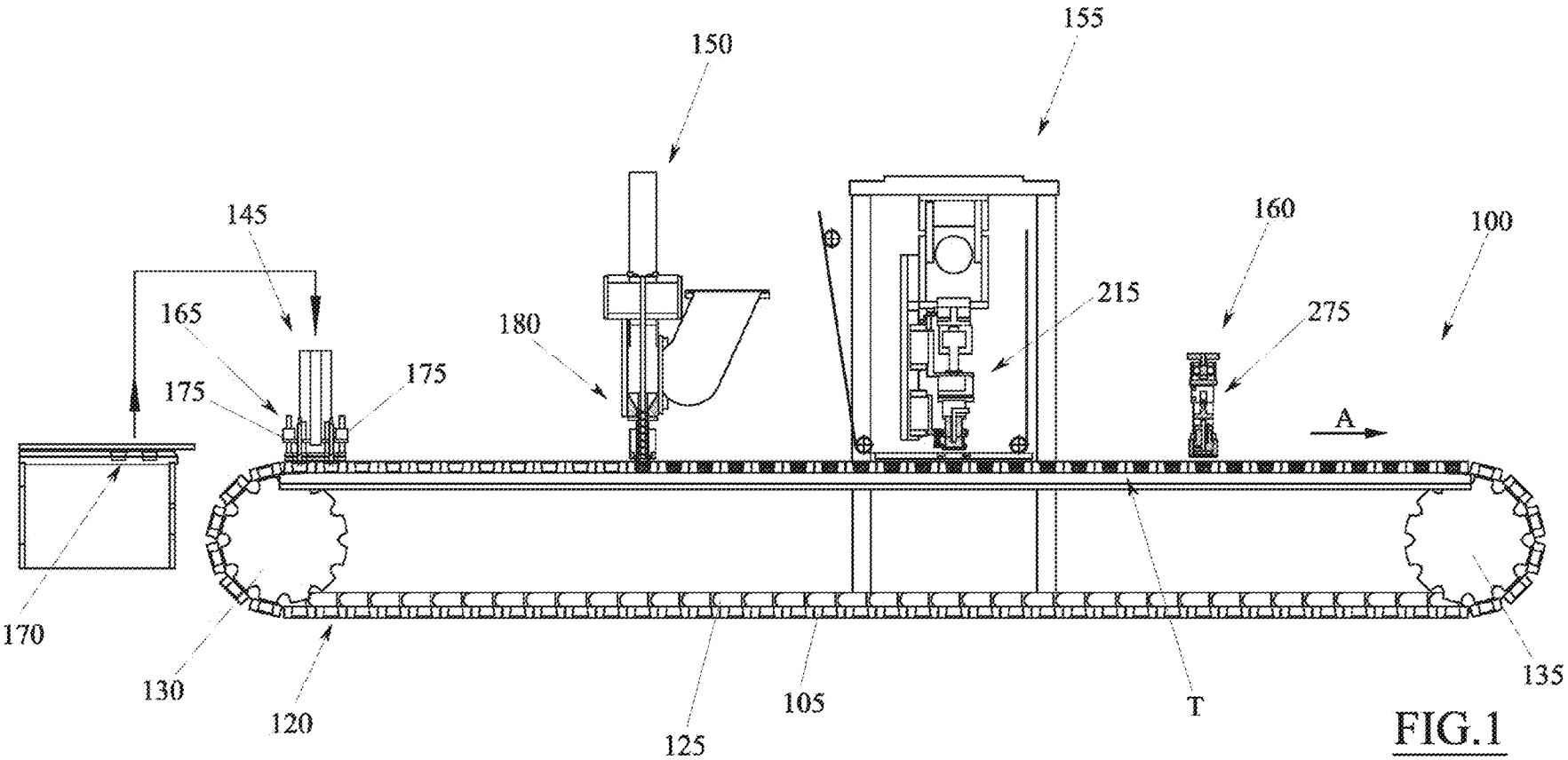
FIG. 1 is a schematic side view of an apparatus according to an implementation embodiment of the present invention.
Figure 2:
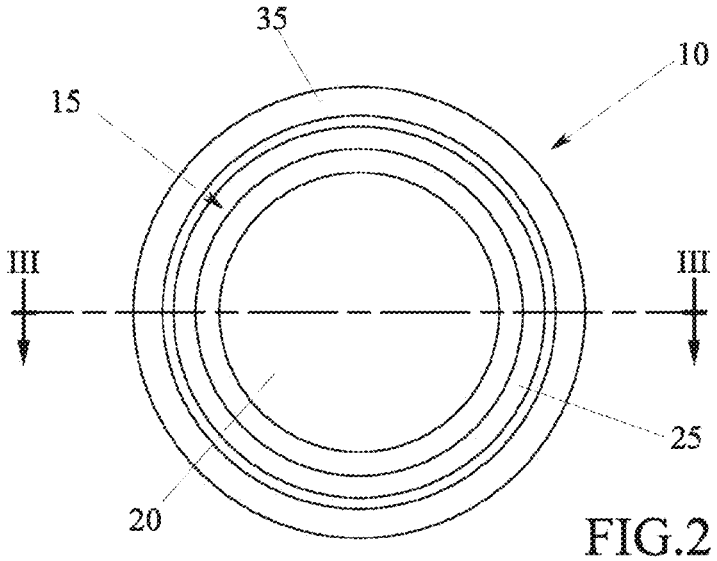
FIG. 2 is a bottom view of a capsule obtainable with the apparatus of FIG. 1.
Figure 3:
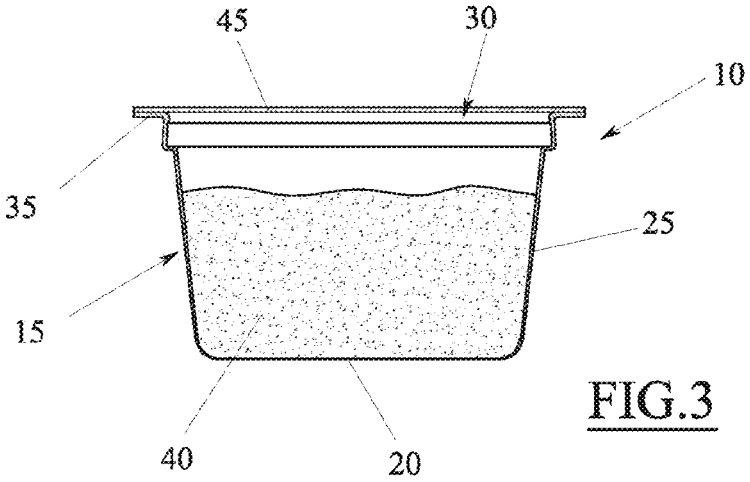
FIG. 3 is the section III-Ill of FIG. 2.
Figure 4:
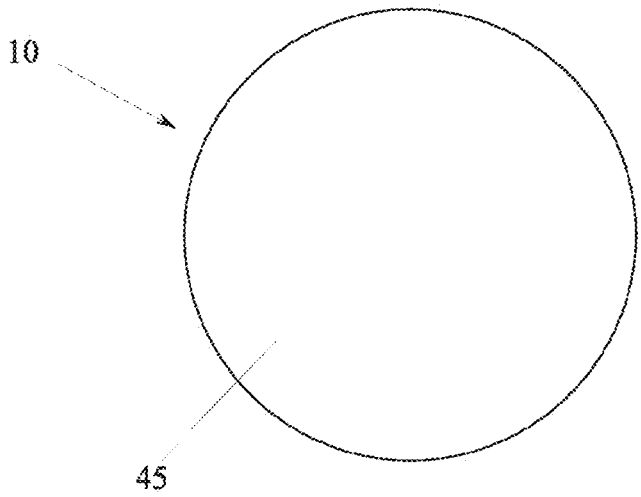
FIG. 4 is a view from above of the capsule of FIG. 2.

FIG. 1 shows an apparatus 100 for packaging disposable capsules 10 intended for preparing beverages, typically for hot drinks such as coffee, tea, herbal tea or other. Each capsule 10 generally comprises a glass-shaped body 15, which includes a bottom wall 20 and a side wall 25, for example of cylindrical or frusto-conical shape, whose top edge defines a mouthpiece 30 and is surrounded by a perimeter flange 35 projecting radially outwards.

The glass-shaped body 15 can be made of aluminium or plastic material, for example by means of an injection moulding process or by thermoforming.

The glass-shaped bodies 15 are generally manufactured separately, by means of plants independent from the apparatus 100.

The capsule 10 further comprises a dose 40 of a food substance, for example in granular or powdery form, which is contained inside the glass-shaped body 15 and is intended to make the drink by infusion and/or percolation.

The food substance can be for example ground coffee or other similar substance. Finally, the capsule 10 comprises a closing film 45 which is fixed, for example welded, on the perimeter flange 35 of the glass-shaped body 15, so as to airtighly close the mouthpiece 30 and seal the dose 40 of food substance inside.

The closing film 45 can also be made of aluminium or plastic material.

The inner volume of the capsule 10 is reduced with respect to the external environment, so that the dose 40 of food substance is packaged under vacuum.

To package capsules 10 such as the one outlined above, the apparatus 100 comprises a plurality of support elements 105, which are preferably all identical to one another.

As illustrated in FIG. 8, each of these support elements 105 can be shaped as an elongated body having a flat surface 110, a thickness H extending perpendicularly to the flat surface 110, a width W extending perpendicularly to the thickness H and a prevailing dimension extending perpendicularly to the thickness H and to the width W and which defines the length L.

Figure 7:
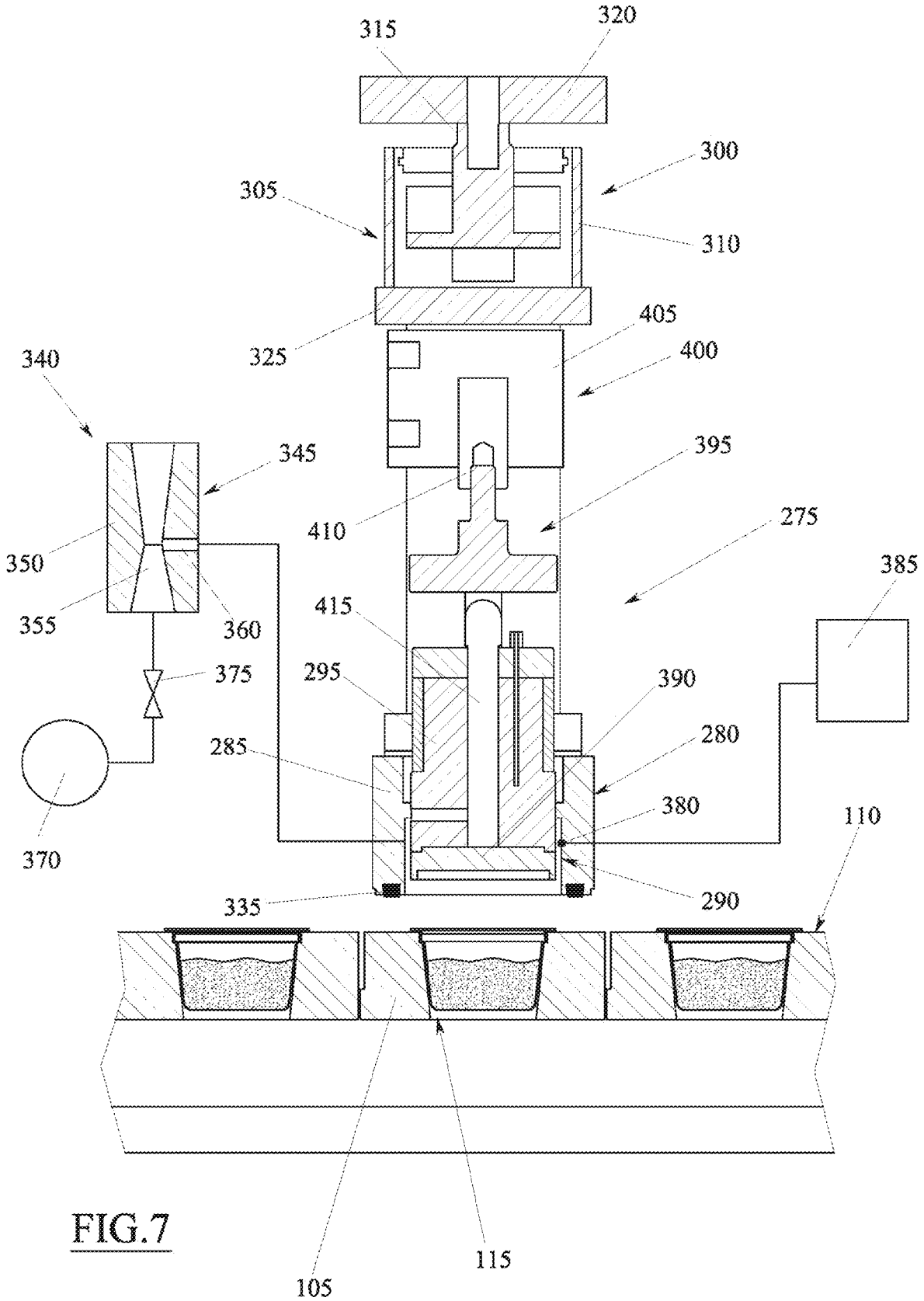
FIG. 7 is a detail showing the sealing station of the apparatus of FIG. 1.

Each support element 105 comprises a plurality of housing seats 115, each of which is adapted to house and hold the glass-shaped body 15 of a respective capsule 10 (see for example FIG. 7).

In the illustrated example, each housing seat 115 is defined as a through opening that extends from the flat surface 110 with an axis parallel to the thickness H.

However, it is not excluded that, in other embodiments, said opening can be blind, that is that it can be made by a cup-shaped cavity, closed on the bottom and opened only at the flat surface 110.

In any case, the shape of this opening is preferably complementary to the shape of the side wall 25 of the glass-shaped body 15, so that the latter can be inserted coaxially with the perimeter flange 35 which remains resting on the flat surface 110.

The housing seats 115 of each support element 105 are arranged placed side by side to one another with the respective axes parallel to each other, and arranged in a row along the length L.

In the illustrated example, each support element 105 comprises six housing seats 115 but, in other embodiments, the number of housing seats 115 could change.

The support elements 105 can be made of metallic material, for example steel.

The apparatus 100 further comprises a driving system, generally indicated with 120, which is adapted to advance the support elements 105 in sequence along a predetermined closed route.

This closed route comprises an operative tract, indicated with a T in FIG. 1, in which the support elements 105 are adapted to advance along a predetermined rectilinear and horizontal advancement direction A.

At the operative tract T, the support elements 105 are arranged parallel to each other and oriented transversely (e.g. perpendicularly) with respect to the advancement direction A.

In other words, each support element 105 in the operative tract T is oriented so that its length L is transverse (e.g. perpendicular) with respect to the advancement direction A and parallel to the length of all the other support elements L that are located in the operative tract T.

In the operative tract T, the support elements 105 are also mutually placed side by side, with the respective flat surfaces 110 arranged horizontally, mutually coplanar and turned upwards.

In this way, the support elements 105 define a sort of band or belt the width of which corresponds to the length L of each support element 105 and the length of which is substantially equal to the sum of the widths W of the support elements 105 that are located at the operative tract T.

The driving system 120 of the support elements 105 can comprise for example two chains 125 (only one of which is visible in FIG. 1) wound in a closed route around a pair of transmission wheels 130 and 135 having parallel and horizontal rotation axes. The transmission wheel 130 can be driven in rotation by a suitable motor (not illustrated), for example by an electric motor, thus causing the chains 125 to slide.

The support elements 105 can be firmly fixed to the chains 125, so as to follow the route thereof.

The driving system 120 is adapted to advance the support elements 105 in a discontinuous manner and by discrete steps, stopping them one after the other at a plurality of operative stations.

These operative stations are arranged above the operative tract T and, with respect to the advancement direction A, comprise in sequence a loading station 145, a filling station 150, a covering station 155 and a sealing station 160.

The loading station 145 is generally provided with means for inserting into each housing seat 115 of each support element 105 a glass-shaped body 15, which is empty and without the closing film 45.

Each glass-shaped body 15 is inserted into the relative housing seat 115 so that the perimeter flange 35 rests on the flat surface 110 of the support element 105, oriented with a vertical axis and with the mouthpiece thereof turned upwards.

To allow this insertion, the loading station 145 can comprise a mobile element 165, which is driven by suitable movement members such to be displaced between a pick up position (not illustrated), in which it overlays to a conveyor 170 adapted to feed the glass-shaped bodies 15, and a release position (illustrated in FIG. 1), in which it overlays to at least one support element 105 which is located in the operative tract T. This mobile element 165 can comprise at least one array of gripping members 175, each of which is adapted to hold a glass-shaped body 15.

For example, each gripping member 175 can comprise a vertical rod adapted to fit into the glass-shaped body 15 and whose lower end carries a gripping system.

The press members 175 of the array can be equal in number to the number of housing seats 115 of each support element 105 and can be arranged so that, when the mobile element 165 is located in the release position, each gripping member 175 is vertically aligned with a respective housing seat 115 of the support element 105 which is located at the loading station 145.

In this way, the mobile element 165 is adapted to pick up a whole row of glass-shaped bodies 15 from the conveyor 170 and simultaneously release them in the housing seats 115 of the support element 105.

Preferably, the mobile element 165 can comprise two arrays of gripping members 175 mutually placed side by side, so as to be adapted to load the glass-shaped bodies 15 on two support elements 105 at a time.

In any case, after the glass-shaped bodies 15 have been released, the gripping members 175 are raised, allowing the support elements 105 to advance towards the filling station 150.

The filling station 150 is generally provided with means for filling each glass-shaped body 15, which is located inside the housing seats 115, with a dose of the food product 40.

For example, the filling station 150 can comprise a plurality of dispensing groups 180, equal in number to the number of housing seats 115 of each support element 105 and arranged mutually placed side by side to form a row in a transverse direction (e.g. perpendicular) with respect to the advancement direction A.

Figure 5:
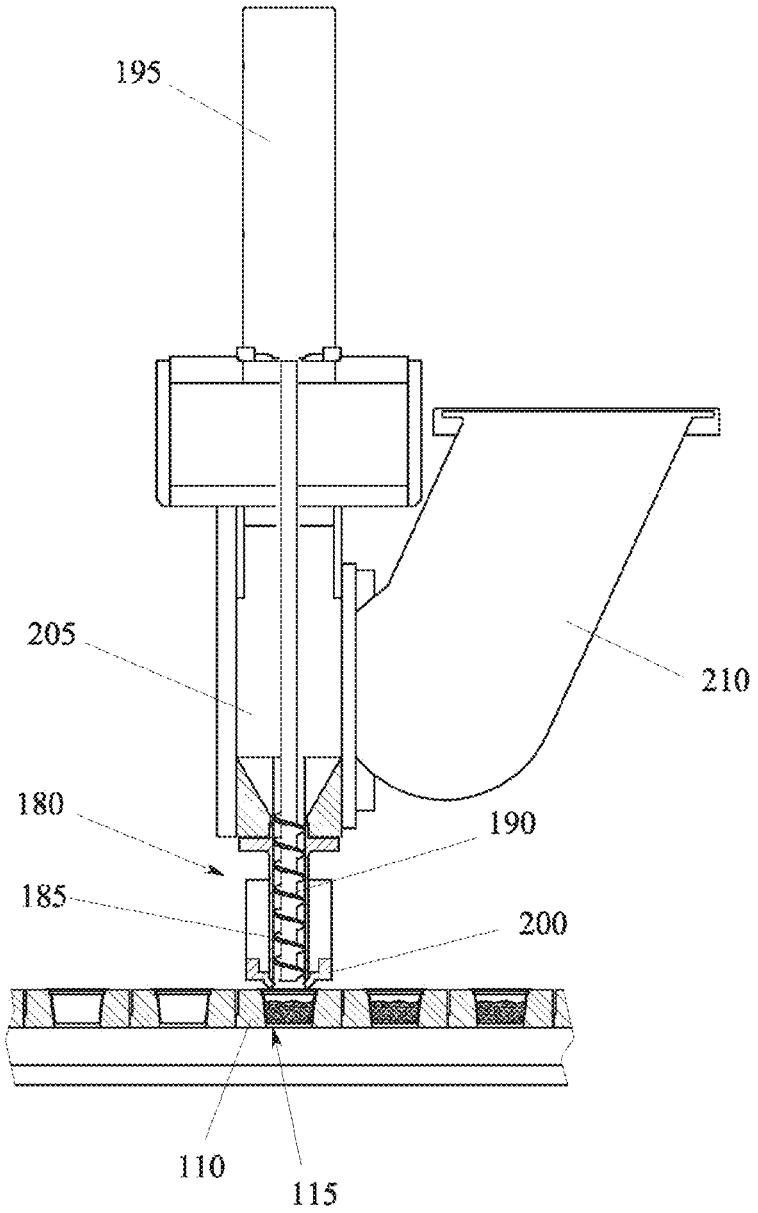
FIG. 5 is a detail showing the filling station of the apparatus of FIG. 1.

As illustrated in FIG. 5, each dispensing group 180 can comprise a cylindrical body 185 with vertical axis, which is positioned above the operative tract T and is coaxially aligned with a respective housing seat 115 of the support element 105 which is located in the filling station 150.

Inside this cylindrical body 185 there is coaxially inserted an auger 190, which is driven by a suitable motor 195 by known transmission systems.

At the lower end of the cylindrical body 185 a calibrated nozzle 200 can be associated, which has a through cavity, coaxial with the auger 190, to allow the powdered substance to be dispensed downwards.

The upper end of the cylindrical body 185 can lead into a collection chamber 205, having bigger dimensions, which is in communication with a system for feeding the food substance, for example with a loading hopper 210.

By putting the auger 190 in rotation, part of the food substance contained in the collection chamber 205 is made to slide in a controlled manner along the cylindrical body 185 and, for example through the calibrated nozzle 200, is released inside the glass-shaped body 15 which is located in the corresponding housing seat 115 of the underlying support element 105.

The amount of powdered substance dispensed by each dispensing group 180 can be controlled by adjusting the rotation speed of the auger 190.

Once the dispensing of the food substance across the whole row of glass-shaped bodies 15 has been terminated, the support element 105 is made to advance towards the covering station 155.

The covering station 155 generally comprises means for applying and fixing on the mouthpiece of the glass-shaped bodies 15, which are inserted in the housing seats 115 of the support element 105, the respective closing film 45.

For example, the covering station 155 can comprise a plurality of cutting and welding groups 215, equal in number to the number of housing seats 115 of each support element 105 and arranged mutually placed side by side to form a row in a transverse direction (e.g. perpendicular) with respect to the advancement direction A.

Figure 6:
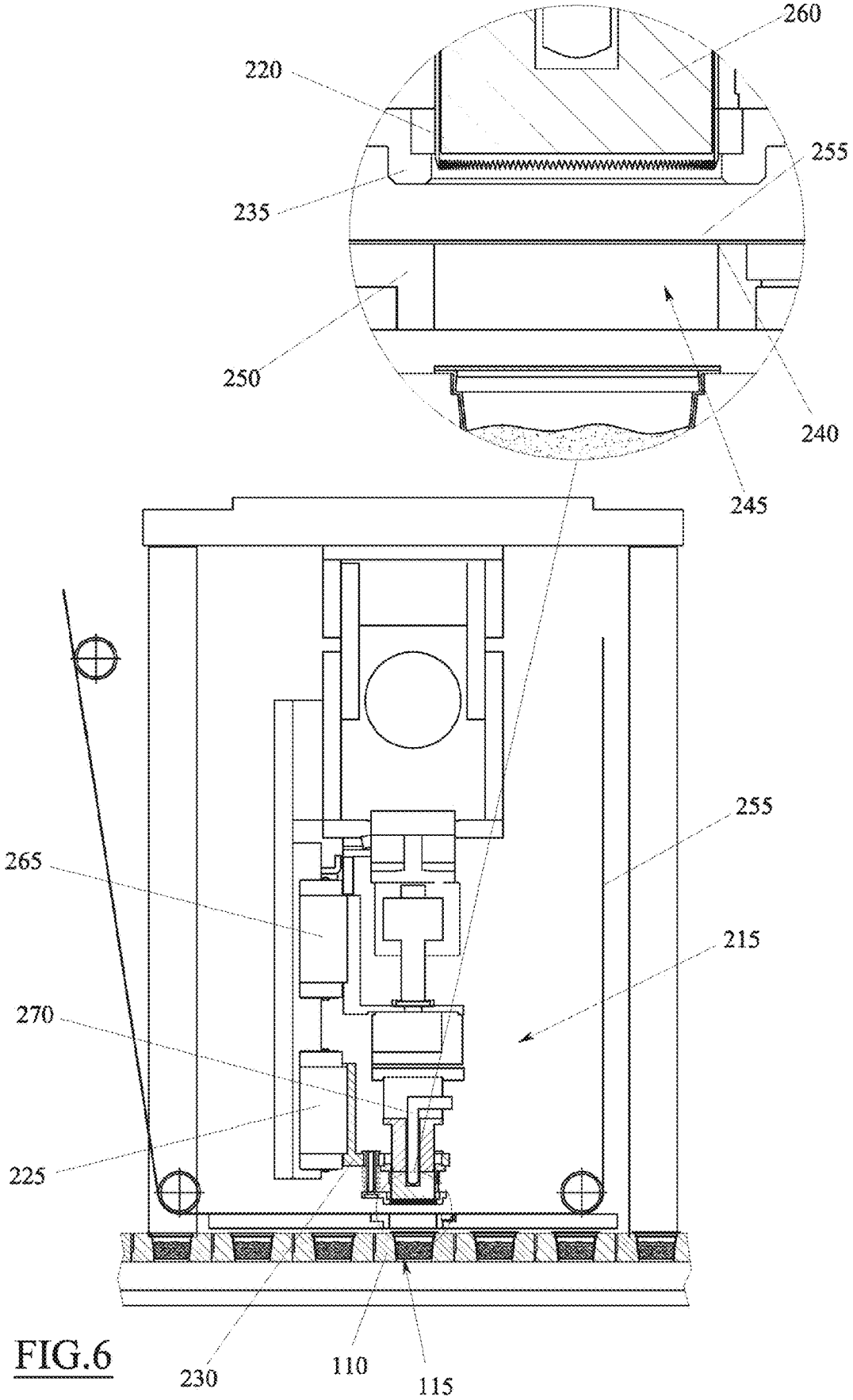
FIG. 6 is a detail showing the covering station of the apparatus of FIG. 1.

As illustrated in detail in FIG. 6, each cutting and welding group 215 can comprise a cylindrical blade 220 with vertical axis, which is positioned above the operative tract T and is coaxially aligned with a respective housing seat 115 of the underlying support element 105.

The cylindrical blade 220 has a diameter substantially equal to and in any case not lower than the outer diameter of the perimeter flange 35 of the glass-shaped body 15.

Suitable driving members 225, for example a pneumatic jack, can be associated with the cylindrical blade 220, which are adapted to move it along a vertical direction between a raised position (shown in the figures), wherein the cylindrical blade 220 is distant from the support element 105, and a lowered position (not shown), wherein the cylindrical blade 220 is closer to the support element 105.

For example, the cylindrical blade 220 can be rigidly fixed to a support bracket 230 which is moved vertically by the driving members 225.

An annular pad 235 can also be associated with the cylindrical blade 220, which is coaxially inserted on the cylindrical blade 220 and is vertically movable with respect to the latter between a first position (shown in the figures), wherein the annular pad 235 projects slightly below the cylindrical blade 220, and a second position (not shown), wherein the annular pad 235 is higher than the cylindrical blade 220.

For example, the annular pad 235 can be connected to the same support bracket 230 to which the cylindrical blade 220 is fixed but through a suspension system, for example a spring, which allows it to perform the aforesaid relative movements.

The cutting and welding group 215 can further comprise a counter-blade 240, which can be defined by the edge of a cylindrical through opening 245 obtained in a plate 250.

The cylindrical through opening 245 is placed coaxially with the cylindrical blade 220 and has a diameter substantially equal to the diameter of the latter or in any case not lower.

The plate 250 can comprise a plurality of said through openings 245, each of which is placed coaxial to the cylindrical blade 220 of a respective cutting and welding group 215 so as to be able to define the corresponding counter-blade 240.

The plate 250 can be supported by a fixed structure (not illustrated), so as to be always stationary.

When the cylindrical blade 220 is in the raised position (as shown in the figure), the plate 250 is vertically interposed between the cylindrical blade 220 and the underlying support element 105.

Between the cylindrical blade 220 in the raised position and the plate 250 a band 255 of the material is slidably inserted which is adapted to make the closing film 45 of the capsule 10, for example of aluminium or plastic material.

This band 255 is generally arranged horizontally and can slide in direct contact with the plate 250 and can cover all the through openings 245 defined therein.

The band 255 can slide between an unwinding reel and a reel for collecting the scraps, which are not illustrated as they are conventional.

During the operation of each cutting and welding group 215, the cylindrical blade 220 is displaced from the raised position into the lowered position.

Following this displacement, the annular pad 235 first enters into contact with the band 255 blocking it locally against the plate 250, after which the cylindrical blade 220, continuing to slide vertically with respect to the annular pad 235, cuts the band 255 separating a disk that defines the closing film 45.

Each cutting and welding group 215 further comprises a welding element 260, which is substantially shaped like a cylindrical punch coaxially contained within the cylindrical blade 220.

This welding element 260 is connected to driving members 265, for example to a further pneumatic jack, which are adapted to move it, inside the cylindrical blade 220, between a retracted position (illustrated in the figures), wherein the welding element 260 is placed above the lower edge of the cylindrical blade 220, and an extracted position (not illustrated), wherein the welding element 260 projects below the cylindrical blade 220.

In this way, after the cylindrical blade 220 has performed the cutting of the band 255, the welding element 260 is displaced from the retracted position into the extracted position, pushing the closing film 45 so as to rest on the perimeter flange 35 of the glass-shaped body 15 which is located in the corresponding underlying housing seat 115.

In this way, the closing film 45 covers the mouthpiece of the glass-shaped body 15 and closes the dose 40 of food substance in its inside.

Heating members 270 are associated with the welding element 260, for example an electrically supplied resistor, which is adapted to increase the temperature of the welding element 260 in order to make it suitable for welding the closing film 45 on the perimeter flange 35.

The conformation of the welding element 260 is however chosen in such a way that the welding takes place only locally, thus ensuring that the closing film 45 remains fixed to the glass-shaped body 15 but at the same time ensuring that between the closing film 45 and the perimeter flange 35 at least one slot remains open which is adapted to put the inner volume of the glass-shaped body 15 in communication with the outside.

Once this welding step has been terminated, the welding element 260 is returned to the retracted position and the cylindrical blade 220 is displaced into the raised position, allowing the support element 15 to advance towards the sealing station 160.

The sealing station 160 generally comprises means adapted to place the inner volume of the glass-shaped bodies 15 under vacuum which are placed in the housing seats 115 of the support element 105 and to completely seal the closing film 45 on the mouthpiece thereof.

As illustrated in FIG. 8, the sealing station 160 comprises a plurality of vacuum groups 275, equal in number to the number of the housing seats 115 of each support element 105, which are arranged above the operative tract T placed mutually side by side to form a row in a transverse direction (e.g. orthogonal) with respect to the advancement direction A.

Each vacuum group 275 comprises a bell-shaped member 280, which has a mouthpiece turned downwards and vertically overlays to a respective housing seat 115 of the support element 105 which is located in the sealing station 160 (see FIG. 7).

In practice, the bell-shaped members 280 of the sealing station 160 are mutually placed side by side in a transverse direction (e.g. orthogonal) with respect to the advancement direction A of the support elements 105 and each of them has the mouthpiece turned downwards and adapted to overlay to a respective housing seat 115 of the support element 105.

For example, each bell-shaped member 280 can comprise an outer body 285, for example of prismatic shape, inside which a through opening 290 with vertical axis and a cross-section are formed (with respect to a section plane orthogonal to said vertical axis) which can be substantially circular in shape.

Preferably, the axis of the through opening 290 coincides with the axis of the corresponding housing seat 115 of the support element 105 which is located at the sealing station 160.

The lower end of the through opening 290 defines the mouthpiece of the bell-shaped member 280 while the upper end is closed, preferably airtightly, by a shutter body 295 which defines the top of the bell-shaped member 280.

In this way, the volume of the through opening 290, comprised between the lower end and the shutter body 295, defines a cup-shaped cavity open only downwards which represents the inner volume of the bell-shaped member 280.

At the lower end, the diameter of the through opening 290 is substantially equal to or slightly greater than the diameter of the perimeter flange 35 of the capsule 10.

The sealing station 160 also comprises a movement apparatus, generally indicated with 300, which is adapted to move each bell-shaped member 280 in a vertical direction between a raised position (shown in the figures), in which the mouthpiece of the bell-shaped member 280 is spaced apart from the support element 105, into a lowered position (not shown in the figures), in which the mouthpiece of the bell-shaped member 280 rests on the support element 105, surrounding and enclosing only the corresponding housing seat 115.

Preferably, the movement apparatus 300 is adapted to move each bell-shaped member 280 independently from the other bell-shaped members 280 of the sealing station 160.

For example, each bell-shaped member 280 can be driven by a respective jack 305, preferably by a pneumatic jack, which comprises a body 310 and a stem 315 sliding axially with respect to the body 310.

In the illustrated example, the stem 315 can be turned vertically upwards and be fixed to a support shelf 320, to which the stems 315 of all the jacks 305 of the sealing station 160 can be fixed and which can be firmly fixed to a support structure (not illustrated) so as to be constantly stationary.

Vice versa, the body 310 of each jack 305 can be rigidly connected to the respective bell-shaped member 280, for example by means of a flange 325, which is rigidly fixed to the body 310 of the jack 305 on the opposite side with respect to the stem 315, and a plurality of connecting studs 330 which rigidly join the flange 325 to the outer body 285 of the bell-shaped member 280.

In this way, following the sliding of the stem 315, the body 310 of each jack 305 is forced to move vertically upwards or downwards, displacing the corresponding bell-shaped member 280 between the raised position and the lowered position.

When a bell-shaped member 280 is in the lowered position, the mouthpiece thereof is closed by the support element 105 and the capsule 10 which is located in the corresponding housing seat 115, delimiting an isolated volume with respect to the external environment.

In the case in which each housing seat 115 is defined by a blind cavity, rather than by a through opening, the isolated volume could be defined by the volume of the cavity of the bell-shaped member 280 and by the volume of the aforesaid blind cavity.

In any case, to ensure the airtightness of the aforesaid isolated volume, each bell-shaped member 280 can comprise an annular gasket 335, which surrounds the mouthpiece thereof and is adapted to be compressed between the bell-shaped member 280 and the support element 105.

For example, this annular gasket 335 can be housed in a seat formed at the lower end of the outer body 285.

Each bell-shaped member 280 is connected to a vacuum generating apparatus, generally indicated with 340, which is adapted to reduce the inner volume of the bell-shaped member 280, when the latter is in the lowered position.

Preferably, the vacuum generating apparatus 340 is adapted to reduce the inner volume of each bell-shaped member 280 independently from other bell-shaped members 280.

For example, the vacuum generating apparatus 340 can comprise a plurality of vacuum generators 345 of the Venturi type, equal in number to the number of bell-shaped members 280 of the sealing station 160, each of which is uniquely and individually connected to the inner volume of a respective bell-shaped member 280.

Each vacuum generator 345 can comprise a body 350 in which a duct 355 is formed which comprises a first convergent tract followed by a second divergent tract.

At the restricted zone of the duct 355, comprised between the convergent tract and the divergent tract, the body 350 can comprise a branch duct 360, which can be connected with the inner volume of the corresponding bell-shaped member 280.

For example, the branch duct 360 can be connected with an opening 365 formed in the outer body 285 of the bell-shaped member 280 and communicating with the inner volume thereof (see FIG. 8).

The duct 355 of the vacuum generator 345 is adapted to be connected to a source of compressed air 370, for example a compressor, so that it can be crossed by an air flow.

This air flow generates, substantially by Venturi effect, a depression at the restricted tract of the duct 355 which, through the branch duct 360, is able to suck the air contained in the isolated volume defined by the bell-shaped member 280 in the lowered position.

In this way, the air contained inside the capsule 10 is also sucked, which can flow through the slot(s) which have remained open between the closing film 45 and the perimeter flange 35 of the glass-shaped body 15, bringing the capsule 10 under vacuum.

The source of compressed air 370 can be connected to all the vacuum generators 345 of the sealing station 160, possibly through respective shut-off valves 375.

In this way, when the pressure inside each bell-shaped member 280 drops below a predetermined threshold value, representative of a satisfactory condition of vacuum in the capsule 10, the corresponding vacuum generator 345 can be deactivated, for example by closing the respective shut-off valve 375, independently from all the other vacuum generators 345.

In this regard, it is preferable for each vacuum group 275 of the sealing station 160 to also comprise a respective pressure sensor 380, which is arranged to measure the pressure inside the corresponding bell-shaped member 280.

The pressure sensors 380 can be connected to an electronic control unit 385, which can be configured to activate each vacuum generator 345, for example by opening the corresponding shut-off valve 375, when the corresponding bell-shaped member 280 is brought into the lowered position, and to deactivate each vacuum generator 345, for example by closing the corresponding shut-off valve 375, only when the pressure value measured by the corresponding pressure sensor 380 drops below the threshold value.

This ensures that the desired degree of vacuum is separately generated in all the capsules 10.

Each vacuum group 275 of the sealing station 160 can also comprise a respective welding element 390, which is contained in the inner volume of the corresponding bell-shaped member 280, so as to complete the welding of the closing film 45 on the capsule 10.

For example, each welding element 390 can be rigidly fixed or be an integral part of the shutter body 295 which defines the top of the respective bell-shaped member 280.

Together with the shutter body 295, each welding element 390 can be movable, inside the corresponding bell-shaped member 280, between a raised position (shown in the figures), wherein the welding element 390 is spaced apart from the mouthpiece of the bell-shaped member 280, to a lowered position (not illustrated), wherein the welding element 390 is closer to said mouthpiece, preferably coplanar, or almost, therewith.

To carry out this vertical movement, the sealing station 160 can comprise a second movement apparatus, generally indicated with 395, which is adapted to move each welding element 390 between said raised position and said lowered position.

Preferably, said second movement apparatus 395 can be adapted to move each welding element 390 independently from the other welding elements 390 of the sealing station 160.

For example, each welding element 390 can be driven by a respective jack 400, preferably by a pneumatically operated jack, which comprises a body 405 and a stem 410 sliding axially with respect to the body 405.

In the illustrated example, the stem 410 can be turned vertically downwards and be rigidly fixed to the welding element 390, for example through the shutter body 295. Vice versa, the body 405 can be rigidly connected to the flange 325 which brings the jack 305 so as to be suitable for driving the movement of the outer body 285 of the bell-shaped member 280.

For example, the jack 400 and the jack 305 can vertically overlay to each other.

In this way, following the sliding of the stem 410, the welding element 390 is able to slide inside the outer body 285 of the bell-shaped member 280, displacing itself between the raised position and the lowered position.

However, it is not excluded that, in other embodiments, the driving of the outer body 285 of the bell-shaped member 280 and that of the relative welding element 390 may take place differently.

For example, the welding element 390, possibly through the respective shutter body 295, could be rigidly connected to a driving jack, while the outer body 285 could be connected to the welding element 390 by means of a suspension system, similar to the one illustrated with reference to the cylindrical blade 220 and to the annular pad 235 of the covering station 155.

In this way, during a displacement of the welding element 390 downwards, the outer body 285 would first reach the contact with the support element 105, creating the isolated volume in which it is possible to generate the vacuum, after which, continuing to lower the welding element 390, the latter could continue to slide with respect to the outer body 285 until it reaches its lowered position.

In any case, each welding element 390 is put into operation, i.e. it is brought into the lowered position, only after the desired vacuum degree has been reached in the respective bell-shaped member 280, preferably independently from the other welding elements 390.

For example, the displacement of each welding element 390 of the sealing station 160 can be controlled by the electronic control unit 385, based on the measurement carried out by the corresponding pressure sensor 380.

Heating members 415 are associated with the welding element 390, for example an electrically supplied resistor, which is adapted to increase the temperature of the welding element 390 in order to make it suitable for welding the closing film 45 on the perimeter flange 35 of the glass-shaped body 15.

In this regard, the conformation of the welding element 390 can generally be that of a ring, arranged coaxially with respect to the corresponding housing seat 115 of the underlying support element 105, and having dimensions such as to be able to rest on the perimeter flange 35 of the glass 15 contained in said housing seat 115, obviously with the interposition of the closing film 45.

For example, the inner diameter of the ring which defines the welding element 390 can be substantially equal to the inner diameter of the perimeter flange 35, while the outer diameter thereof can be substantially equal to the outer diameter of the perimeter flange 35.

In other embodiments, the welding element 390 could be shaped as a complete disk, having an outer diameter corresponding to that of the ring outlined above.

The welding element 390 can be adapted to weld the covering film 45 onto the whole perimeter flange 35 of the glass-shaped body 15.

However, it is not excluded that, in other embodiments, the welding element 390 can be shaped so as to be adapted to weld on the perimeter flange 35 only those zones of the closing film 45 which have not previously been welded in the covering station 155.

In any case, at the end of this second welding step, the inner volume of the capsule 10 must be airtightly isolated with respect to the external environment, preserving the dose 40 of food substance under a vacuum condition.

For this purpose, the electronic control unit 385 can be configured to control each vacuum group 275 independently from the others and according to the following scheme.

When a support element 105 is stopped at the sealing station 160, the electronic control unit 385 controls the bell-shaped member 280 such to move in the lowered position.

At this point, the electronic control unit 385 activates the vacuum generator 345, for example by opening the shut-off valve 375 through which it is connected to the source of compressed air 370.

In this way, a depression is created in the inner volume of the bell-shaped member 280 which sucks the air from the capsule 10, thanks to the slots that have remained open between the closing film 45 and the perimeter flange 35 of the glass-shaped body 15.

The pressure level in the inner volume of the bell-shaped member 280 is measured by the corresponding pressure sensor 380.

When the pressure measured by the pressure sensor 380 drops to a predetermined threshold value, the electronic control unit 385 controls the welding element 390 to displace itself into the lowered position, while simultaneously maintaining the bell-shaped member 280 stopped and the vacuum generator 345 active.

Immediately after the welding element 390 has completed the welding of the closing film 45, by sealing the dose 40 of food substance inside the capsule 10 under vacuum, the electronic control unit 385 can deactivate the vacuum generator 345, for example by closing the shut-off valve 375, and can control the welding element 390 and the bell-shaped member 280 such to displace themselves again into the raised position.

When all the bell-shaped members 280 of the sealing station 160 have reached the raised position, the support element 105 can be made to advance, for example towards a station for unloading the capsules 10.

As anticipated, all these operating steps can be controlled by the electronic control unit 385 independently for each vacuum group 275 and, therefore, for each capsule 10 which passes into the sealing station 160.

In this way a great rapidity of execution (since the volume of the single bell-shaped members 280 is relatively small and it therefore requires little time to reach the desired vacuum value), a high energy saving (since the vacuum generators 345 are kept operating only for the time strictly necessary to place the corresponding bell-shaped member 280 under vacuum) and great efficiency (since it is possible to check and ensure that each single capsule 10 being processed has reached the desired vacuum level) are guaranteed.

Thanks to the independent control of the vacuum groups 275 it is also advantageously possible to avoid performing the step for sealing under vacuum on those single capsules 10 which may have a defect, which may subsequently be discarded, without thereby interfering with the execution of the same vacuum sealing step of the other capsules 10.

Obviously, an expert in the field may make several technical-applicative modifications to the apparatus 100 described above, without departing from the scope of the invention as hereinbelow claimed.

The invention claimed is:

1. An apparatus for manufacturing capsules under vacuum for preparing beverages, comprising:

a plurality of support elements arranged in sequence along a closed route having at least a rectilinear and horizontal operative tract (T), and a driving system adapted to move said support elements along said closed route, advancing them into the operative tract (T) according to a predetermined advancement direction (A) and stopping them one at a time in a plurality of operative stations, wherein each support element comprises a row of housing seats which, at the operative tract (T) of the closed route, are mutually aligned in a horizontal and transverse direction of alignment with respect to the advancement direction (A), wherein the operative stations are arranged above the operative tract (T) of the closed route of support elements and comprise at least:

a loading station for inserting into the housing seats a glass-shaped body having mouthpiece directed upward, a filling station, placed downstream of the loading station with respect to the advancement direction (A) of the support elements, for filling glass-shaped bodies inserted in the housing seats with a food substance adapted to produce a beverage, a covering station, placed downstream of the filling station with respect to the advancement station (A) of support elements, for applying and fixing a closing film on the mouthpiece of glass-shaped bodies inserted in the housing seats, and a sealing station, placed downstream of the covering station with respect to the advancement direction of support elements, for placing under vacuum the inner volume of the glass-shaped bodies placed in the housing seats and for sealing the closing film on the mouthpiece thereof, wherein said sealing station comprises:

a plurality of bell-shaped members arranged mutually placed side by side in a transverse direction with respect to the advancement direction (A) of the support elements, each of which is adapted to overlay to one respective housing seat and has mouthpiece directed downward, a movement apparatus for moving each bell-shaped member in vertical direction between a raised position, wherein its mouthpiece is substantially spaced apart from the support element, to a lowered position, wherein the mouthpiece thereof leans against the support element surrounding the correspondent housing seat, a vacuum generating apparatus to reduce the pressure within the inner volume of bell-shaped members, and a plurality of welding elements, each of which is contained inside a respective bell-shaped member for airtightly welding the closing film on the glass-shaped body contained in the housing seat.

2. The apparatus according to claim 1, wherein the movement apparatus is adapted to move each bell-shaped member independently from other bell-shaped members.

3. The apparatus according to claim 2, wherein the movement apparatus comprises a plurality of jacks, each of which is connected to a respective bell-shaped member such as to move it in vertical direction.

4. The apparatus according to claim 1, wherein the vacuum generating apparatus is adapted to reduce the pressure within the inner volume of each bell-shaped member independently from other bell-shaped members.

5. The apparatus according to claim 4, wherein the vacuum generating apparatus comprises a plurality of vacuum generators of the Venturi type, each of which is connected to the inner volume of a respective bell-shaped member.

6. The apparatus according to claim 1, wherein each welding element comprises an electrically supplied resistor.

7. The apparatus according to claim 1, wherein each welding element is movable, inside the corresponding bell-shaped member, between a raised position, wherein each welding element is distant from the mouthpiece of the bell-shaped member, to a lowered position, wherein each welding element is closer to said mouthpiece.

8. The apparatus according to claim 7, wherein the sealing station comprises a second movement apparatus adapted to move each welding element between said raised position and said lowered position.

9. The apparatus according to claim 8, wherein said second movement apparatus is adapted to move each welding element independently from other welding elements.

10. The apparatus according to claim 1, wherein the sealing station comprises a plurality of pressure sensors, each of which is adapted to measure the pressure inside a respective bell-shaped member.

11. The apparatus according to claim 10, wherein each pressure sensor is connected to an electronic control unit configured for activating each welding element when the pressure value inside the corresponding bell-shaped member, measured by the corresponding pressure sensor, drops to a predetermined threshold value, and for controlling the vacuum generating apparatus such to interrupt vacuum generation inside said correspondent bell-shaped member, after activating said welding element.

* * * * *